US005340506A

United States Patent [19]

Koyama

[11] Patent Number: 5,340,506

[45] Date of Patent: Aug. 23, 1994

[54] METHOD TO SYNTHESIZE DENSE CRYSTALLIZED SODALITE PELLET FOR IMMOBILIZING HALIDE SALT RADIOACTIVE WASTE

[75] Inventor: Tadafumi Koyama, Tokyo, Japan

[73] Assignee: The United States of America as represented by the United States Department of Energy, Washington, D.C.

[21] Appl. No.: 943,624

[22] Filed: Sep. 11, 1992

[51] Int. Cl.[5] ..... G21F 9/16

[52] U.S. Cl. ..... 588/14; 588/252; 423/118; 423/700; 423/DIG. 32; 502/76; 210/682

[58] Field of Search ..... 252/628; 588/252; 264/1.5; 423/118, DIG. 32, 700; 210/751, 682; 502/76

[56] References Cited

U.S. PATENT DOCUMENTS

| | | | |
|---|---|---|---|
| 2,951,793 | 9/1960 | Hansen | 204/1.5 |
| 3,674,709 | 7/1972 | Barrer et al. | 252/454 |
| 4,020,147 | 4/1977 | Shidlovsky | 423/329 |
| 4,028,265 | 6/1977 | Barney et al. | 252/628 |
| 4,125,591 | 11/1978 | Lindsley | 423/328 |
| 4,160,011 | 7/1979 | Estes et al. | 423/328 |
| 4,229,317 | 10/1980 | Babad et al. | 562/54 |
| 4,247,524 | 1/1981 | Leonard | 423/118 |
| 4,289,629 | 9/1981 | Andrews | 210/137 |
| 4,297,304 | 10/1981 | Scheffler et al. | 264/0.5 |
| 4,596,647 | 6/1986 | Miller et al. | 204/212 |
| 4,661,291 | 4/1987 | Yamasaki et al. | 252/629 |
| 4,808,318 | 2/1989 | Komarneni et al. | 210/682 |
| 4,880,506 | 11/1989 | Ackerman et al. | 204/1.5 |

*Primary Examiner*—Donald P. Walsh
*Assistant Examiner*—Ngoclan T. Mai
*Attorney, Agent, or Firm*—Robert J. Fisher; Hugh W. Glenn; William R. Moser

[57] ABSTRACT

A method for immobilizing waste chloride salts containing radionuclides such as cesium and strontium and hazardous materials such as barium. A sodalite intermediate is prepared by mixing appropriate amounts of silica, alumina and sodium hydroxide with respect to sodalite and heating the mixture to form the sodalite intermediate and water. Heating is continued to drive off the water to form a water-free intermediate. The water-free intermediate is mixed with either waste salt or waste salt which has been contacted with zeolite to concentrate the radionuclides and hazardous material. The waste salt-intermediate mixture is then compacted and heated under conditions of heat and pressure to form sodalite with the waste salt, radionuclides and hazardous material trapped within the sodalite cage structure. This provides a final product having excellent leach resistant capabilities.

9 Claims, No Drawings

METHOD TO SYNTHESIZE DENSE CRYSTALLIZED SODALITE PELLET FOR IMMOBILIZING HALIDE SALT RADIOACTIVE WASTE

CONTRACTUAL ORIGIN OF THE INVENTION

The United States Government has rights in this invention pursuant to Contract No. W-31-109-ENG-38 between the U.S. Department of Energy and Argonne National Laboratory.

BACKGROUND OF THE INVENTION

This invention relates to a method for immobilizing radioactive wastes for permanent disposal. More particularly, the invention relates to a method of immobilizing mixed waste chloride salts containing radionuclides and other hazardous materials for permanent disposal.

The recovery of fissionable materials such as uranium and plutonium from spent nuclear reactor fuels can be carried out by electrorefining methods using electrochemical cells of the type described in U.S. Pat. Nos. 4,596,647 and 2,951,793, as well as U.S. Pat. No. 4,880,506. It is the electrorefining method which is being developed for the reprocessing of Integral Fast Reactor (IFR) fuel. In a typical electrorefining cell an electrolyte consisting of a molten eutectic salt mixture such as KCl and LiCl is used to transport the metal or metals to be purified between electrode solutions. When used to reprocess spent nuclear reactor fuels, the salt mixture becomes contaminated with radionuclides, such as $^{137}$cesium, $^{90}$strontium and $^{129}$iodine, hazardous materials such as barium and other species such as sodium, and eventually is no longer suitable for use in the electrorefining cell.

Ideally, the salt would be decontaminated by removing a fraction of the heat-producing radionuclides, primarily cesium and strontium, and any other elements e.g. barium and sodium, which could potentially interfere in the operation of the electrorefiner, and the purified salt would be recycled back to the electrorefiner. However, the separation of cesium and strontium from the salt is difficult, and if they are separated in concentrated form, it would be necessary to dilute them in another matrix material and/or cool them before they could be stored since they are large heat producers. It is, therefore, more practical to dispose of the cesium and strontium and any other radionuclides, including iodides, and toxic metal chlorides along with a portion of the salt matrix. The waste salt containing the cesium, strontium and iodine is a high level waste (HLW), and as such must be disposed of in the geologic repository for HLW. This requires that the waste form be leach resistant to prevent an uncontrolled release of the radionuclides and other hazardous chemicals such as barium, into the groundwater. Since waste salts are chlorides and are very water soluble, a method for encapsulating and immobilizing the waste salt must be identified.

One problem with developing a waste storage medium is that the waste salt consists primarily of chloride salts of alkali metals and as such is not readily amenable to treatment using procedures and techniques developed for immobilizing cesium and strontium in other nuclear waste streams. For instance, the chloride salts cannot be added directly to glass-forming compounds and processed to yield a leach-resistant glass since glasses containing halide ions are relatively water soluble. Therefore, for immobilization in a glass matrix the waste chloride salts must be converted into oxides or other chemical forms compatible with the glass-making process. However, conversion processes are expensive and time-consuming and raise environmental concerns about off-gases produced by the processes. A mortar matrix has also been considered as a possible waste form for the waste chloride salt. A special mortar was developed to incorporate lithium, potassium, cesium and strontium chloride salts into its structure, thereby immobilizing them. However, when irradiated, the water in the mortar was radiolyzed and hydrogen gas was generated.

U.S. patent application Ser. No. 744,753, filed Aug. 14, 1991, and incorporated herein by reference, describes the use of certain zeolites to decontaminate and immobilize waste chloride salts. Contact between the zeolite (for example, zeolite A or mixtures of chabazite and erionite zeolites or mixtures thereof) in the sodium, potassium, or lithium form and the molten salt result in an ion exchange between the radionuclides cesium and strontium and the hazardous material barium in the salt and the sodium, potassium or lithium in the zeolite and the occlusion of up to about 25 wt % of the salt within the molecular cavities of the zeolite. This method has the advantage over many methods in that the radionuclides and barium are concentrated in the zeolite so that some of the salt partially purified of cesium, strontium and barium might be recycled back to the electrorefiner. Although this method is effective for purifying the salt, the method requires the removal of the non-occluded surface salt from the zeolite before it can be sent to storage. Furthermore, problems have been encountered in making dense, leach-resistant waste forms directly from the salt-occluded waste product.

The use of synthetic naturally occurring minerals to store radioactive ions has also been studied. U.S. Pat. No. 4,808,318 describes the use of a modified phlogopite to recover cesium ions from waste solutions. The modified phlogopite containing the cesium ion is then fixed so that it can be safely stored for a long period of time. U.S. Pat. No. 4,229,317 describes a method whereby radioactive iodine, present as alkali metal iodides or iodates is incorporated into a solid by adding appropriate amounts of alkali metal, alumina and silica to the solution, stirring to form a homogenous mixture, drying the mixture to form a powder and compacting and heating the powder under conditions appropriate to form sodalite, whereby the iodine ion is incorporated within the molecular cage of the sodalite ($Na_6[(SiO_2)_6(AlO_2)_6]2NaCl$).

What is still needed is a method of immobilizing mixtures of salts, particularly chloride salts containing radionuclides and other hazardous wastes, so that the highly soluble salts can be safely stored for long periods of time in HLW storage facilities without presenting a hazard to the environment.

SUMMARY OF THE INVENTION

A method has been found by which mixed waste chloride salts containing radionuclides and other hazardous wastes can be incorporated into a synthetic, naturally-occurring mineral to form a leach resistant compact suitable for long-term storage. Furthermore, the method of the invention is compatible for use with the salt-occluded zeolite prepared as described in previously cited U.S. patent application Ser. No. 744,753.

The method of the invention for immobilizing waste chloride salts containing radionuclides and hazardous material for permanent disposal comprises forming a mixture of an effective amount of aluminum oxide, silicon dioxide and sodium hydroxide with respect to the formation of a sodalite, $Na_6[(SiO_2)_6(AlO_2)_6].y[(A)(X)_z]$, where y is greater than 0.5 and less than or equal to 2.0, A is an alkali metal or alkaline earth, X is a halide, and z is either 1 or 2, heating the mixture to a temperature sufficient to partially react the mixture to form water and a sodalite intermediate, maintaining the temperature for a period of time sufficient to drive off the water and to form a water-free sodalite intermediate, mixing the water-free sodalite intermediate with from about 5 to 13 wt. percent mixed chloride salts containing radionuclides and hazardous material to form a waste mixture, and heating the mixture to a temperature and for a period of time sufficient to form sodalite, whereby the chloride salt, the radionuclides and the hazardous material are incorporated into the sodalite, thereby immobilizing the waste chloride salt containing radionuclides and hazardous materials.

Preferably, the water-free sodalite intermediate is mixed with the salt-occluded zeolite to form the waste mixture, the waste mixture containing from 8 to 13 wt % chloride salt, radionuclides and hazardous material. The advantage of mixing the salt-occluded zeolite is that the radionuclides and hazardous material is much more concentrated in the zeolite than it is in the waste salt alone.

It is therefore one object of the invention to provide an effective method for disposing of the waste chloride salt.

It is another object of the invention to provide an improved method for stabilizing waste chloride salts containing radionuclides and other hazardous waste materials.

It is still another object of the invention to provide an improved method for stabilizing waste chloride salts containing radionuclides and other hazardous waste materials so that they may be safely placed in high-level waste facilities for long periods of time without fear of damage to the environment.

It is still another object of the invention to provide an improved matrix material for storing waste chloride salts containing radionuclides such as cesium and strontium and other hazardous wastes such as barium so that they may be safely stored for long periods of time without causing damage to the environment.

Finally it is the object of the invention to provide an improved method of stabilizing zeolite-occluded waste chloride salts containing strontium, cesium and barium, so that they may be safely stored for long periods of time without fear of causing damage to the environment.

DETAILED DESCRIPTION OF THE INVENTION

These and other objects of the invention may be met by first preparing sodalite intermediate by intimately mixing 2 moles of NaOH, 1 mole of $Al_2O_3$, and 2 moles of $SiO_2$, heating the mixture to a temperature of between 250° and 600° C., preferably between 300° and 500° C., for 2 to 20 hours to drive off water and form a water-free sodalite intermediate consisting essentially of a reactive mixture of $NaAlO_2$, $Na_2SiO_3$, $Al_2O_3$ and $SiO_2$. The product is then cooled in a dry atmosphere to about room temperature and then ground to a particle size of between 50 and 500 μm. The powdered sodalite intermediate is then mixed with either waste chloride salt containing radionuclides and hazardous material or salt-occluded zeolite, which been previously ground to a similar size, in amounts such that the mixture contains between 5 and 13 wt % chloride salts. The sodalite intermediate-waste salt mixture is first compacted at 250° to 500° C. and at pressures from about 10 up to 70 MPa or greater for 1 to 8 hours to form a green compact. The compact is then reacted by either maintaining the pressure and raising the temperature to between 700° and 900° C. for 20 to 200 hours or heating the green compact in a closed container to 700° to 900° C. for 20 to 200 hours to react the sodalite intermediate to form sodalite. The product waste form consists of the salt and the radioactive and hazardous components encapsulated in the molecular structure of the sodalite.

Preferably once the water-free sodalite intermediate has been formed, it is maintained in a water-free environment to prevent reabsorption of water which may later affect the quality of the final product.

As described in the reference patent application, the salt-zeolite product may be prepared by contacting molten waste chloride salt containing the chlorides of cesium, strontium, barium and other radioactive and hazardous waste components with dehydrated zeolite in the sodium, lithium, or potassium form, said zeolite containing molecular cavities, maintaining the contact at 400° to 500° C. for up to 20 hours, a period of time sufficient for the salt to penetrate the zeolite cavities thereby occluding salt within the zeolite and for cesium, strontium and barium in the non-occluded salt to ion-exchange with the sodium, lithium, or potassium in the zeolite. After cooling, the resultant material consists of zeolite with the ion-exchanged cesium, strontium, and barium and occluded salt in the molecular cavities, and with salt adhering to the external surfaces of the zeolite particles. Using the invention, it is not necessary to remove large fractions of the surface salt to make a leach resistant waste form, because the surface and occluded salt are contained in the sodalite molecules. It is desirable to remove as much of the surface salt as possible from the zeolite-salt product to minimize waste volumes.

The formation of sodalite appears to proceed in two stages: During the first stage, the sodalite intermediate is formed by the following reaction:

$$2NaOH+SiO_2=Na_2SiO_3+H_2O,$$

and $$2NaOH+Al_2O_3=2NaAlO_2+H_2O.$$

Following these reactions to form the intermediate and water, sodalite is formed by, $(6-2\alpha)NaAlO_2+\alpha Na2SiO_3+\alpha Al_2O_3+(6-\alpha)SiO_2+$(chloride salt or salt-occluded zeolite)=[sodalite] where $\alpha$ represents the variability in the fraction of the sodium hydroxide reacted with silica or alumina of the first stage reactions. When zeolite is used in the second stage, the zeolite may be transformed into other aluminosilicate compounds, for example sodalite. It is important that the reaction conditions during the first stage be maintained for a period of time sufficient for the water resulting from the reaction to be driven off so that a water-free intermediate results. This prevents water from reacting with the chloride salt in the second stage which would result in corrosive conditions in the reactor. Also, any water present during the second stage may cause the formation of glassy phases or aluminosilicates without molecular cages which do not have the capability for containing chloride salt.

Preferably the sodalite intermediate is mixed with the powdered salt-zeolite since the radioactive and hazardous components can be concentrated in this material. Alternatively, the sodalite intermediate may be mixed directly with the waste salt containing the radionuclides and hazardous material. The mixture may contain at least 5 and no more than about 13 wt % of the chloride salts including radioactive and hazardous components. Amounts less than about 5 wt % will result in a waste form with an excessive volume while amounts greater than about 13 wt % will not result in the incorporation of all the salt in the sodalite molecular cages. Preferably, the mixture will contain about 8 to 11 wt % of the salt including the radioactive and hazardous components.

Preferably the sodalite-intermediate, the waste salt and/or the salt-occluded zeolite are powdered before mixing to form the waste mixture in order to facilitate the intimate mixing of the components and formation of the green compact. The powder can be formed by any convenient means. A powder size of from about 50 to 500 μm has been found satisfactory.

Once the salt-occluded zeolite-intermediate or salt-intermediate mixture has been prepared and well mixed, it can be compacted to form a green pellet. While the conditions for preparation of the green pellet are not critical, heating at 325° C. in a uniaxial press under a pressure of about 70 MPa for about 4 hours was found to prepare a suitable compact. This step should be done in a dry inert atmosphere.

The green compact must be heated to a temperature and for a period of time sufficient to form the sodalite. Preferably, the heating takes place in a closed vessel to prevent volatilization of the salts or radionuclides. The temperature may vary from about 700° C. to about 1000° C., preferably from about 700° C. to 900° C. Sodalite formation required temperatures greater than 700° C. while decomposition begins at temperatures greater than 1000° C. A heating period of 20 to 200 hours was found sufficient for sodalite formation. This step should be done in a dry, inert atmosphere.

Alternatively to forming a compact and then heating the compact to form the sodalite, the sodalite can be formed directly from the salt-intermediate mixture by placing this mixture in a hot press and heating under a pressure of about 70 MPa to a temperature of 700° to 800° C. and for a period of time up to 200 hours.

The following Examples are given to illustrate the invention, but are not to be taken as limiting the scope of the invention which is defined in the appended claims.

EXAMPLE I

Typical Preparation of the Sodalite Intermediate

The sodalite intermediate was prepared by intimately mixing 2.8 g of NaOH, 32.8 g of $Al_2O_3$, and 41.4 g of $SiO_2$ (mole ratio of 2:1:2; weight ratio of about 1:1.27:6.60). About 100 g of this mixture is placed in a high-fired alumina crucible and heated to 500° C. for 30 hours. The result is the reaction of the NaOH to form water, which is driven off, and compounds such as $NaAlO_2$, $Na_2SiO_3$, and $Na_2Si_2O_5$, which are components of the sodalite intermediate along with $Al_2O_3$ and $SiO_2$. The products are kept dry and ground to a fine powder with particle sizes less than 500 μm. The intermediate prepared in this manner is more reactive than a mixture of the pure materials. The reaction can be carried out in air, but the products are stored under a dry inert atmosphere, for example purified argon or helium.

EXAMPLE II

Immobilization of Zeolite-Salt Mixture

A synthetic zeolite-salt waste material was prepared in a dry, inert atmosphere by mixing about 30 g of molten LiCl-KCl eutectic salt containing about 0.8 wt % $SrCl_2$, 2 wt % $BaCl_2$, and 4.9 wt % CsCl with about 5 g of the sodium form of zeolite A. After gently mixing the salt and zeolite at 400° C. for 8 hours, 21.8 g of the salt was separated by forcing it through a sintered steel filter having 50 μm pores, and passing a stream of argon gas through the residue for about 1 hour. The filtered molten salt contained reduced amounts of strontium, cesium and barium, and negligible amounts of zeolite decomposition products. The salt-zeolite residue, which weighed 13.2 g, contained about 94% of the strontium, 85% of the barium, and 45% of the cesium that were in the original salt. The salt-zeolite residue was removed from the filter and ground to a powder with a particle size of less than 5005 m.

EXAMPLE III

Typical Immobilization of Zeolite-Salt Waste Material

In a dry, inert atmosphere, 30 g of sodalite intermediate prepared as described in EXAMPLE I, and ground to a particle size of less than 500 μm, was intimately mixed with 6.6 g of the zeolite-salt waste prepared as described in EXAMPLE II above. The resulting mixture contained sufficient intermediate to encapsule the 4.1 g of salt into sodalite if none of the zeolite converted to sodalite.

This mixture was placed in a steel die, and heated to 325° C. at 70 MPa for 6.5 hours. The resulting green pellet was sealed in a stainless steel container and heated for 750° C. for 168 hours. The final pellet was hard and strong.

EXAMPLE IV

Typical Preparation of Sodalite from Waste Salts

Crushed salt (LiCl-56 wt % KCl) was intimately mixed with sodalite intermediate prepared as described in EXAMPLE I in proportions that the salt content of the mixture is 10 wt %. The mixture is heated to 360° C. in a steel die and pressed at 60 MPa. The preparation of a suitable green pellet is aided by the temperature being above the salt melting point. This pellet is then placed in a sealed stainless steel container and heated to 700° C. for 100 hours to prepare a final pellet that is white, and very hard.

EXAMPLE V

The pellet prepared according to EXAMPLE IV was subjected to a leaching test similar to the standard procedure set forth in ANS 16.1. The pellet had a Leachability Index of about 13 for strontium and 12 for cesium indicating that the leach rates of these elements were about one-tenth their leach rates from mortars with the best formulations.

The embodiment of the invention in which an exclusive property or privilege is claimed is defined as follows:

1. A method for immobilizing waste chloride salts containing radionuclides and hazardous material for permanent disposal comprising:

forming a mixture of an effective amount of alumina, silica and sodium hydroxide with respect to the formation of a sodalite, heating the mixture to a temperature sufficient to partially react the mixture to form water and a sodalite intermediate, maintaining the temperature for a period of time sufficient to drive off the water and form a water-free sodalite intermediate, mixing the water-free sodalite intermediate with the mixed chloride salt containing radionuclides and hazardous material to form a waste mixture, the waste mixture containing about 5 to 13 wt % chloride salt, heating the waste mixture under pressure, to a temperature sufficient to form sodalite, and maintaining the temperature and pressure for a period of time sufficient to react the sodalite intermediate to form sodalite, the waste chloride salt containing the radionuclides and hazardous material being contained within the sodalite, thereby immobilizing the waste chloride wait containing radionuclides and hazardous material for permanent disposal.

2. The method of claim 1, wherein the mixture of alumina, silica, and sodium hydroxide is heated about 250° to 600° C. to form the sodalite intermediate.

3. The method of claim 2, wherein the waste mixture is pressed to form a green compact before heating under pressure to form sodalite.

4. The method of claim 3, wherein the waste mixture is pressed at about 250° to 500° C. and at pressures up about 70 MPa to form the green compact.

5. The method of claim 4, wherein the green compact is then heated under pressure to about 700° to 900° C. to form sodalite.

6. The method of claim 5, wherein the green compact is heated for 20 to 200 hours.

7. The method of claim 1, wherein the waste chloride salt also contains zeolite.

8. In the method for immobilizing molten waste chloride salts containing radionuclides and other hazardous material for permanent disposal by contacting the waste chloride salt containing cesium, strontium, barium and other waste salt components with dehydrated zeolite A in the potassium, sodium or lithium form, said zeolite containing molecular cavities, maintaining the contact for a period of time sufficient for the salt to penetrate the cavities in the zeolite, thereby occluding a portion of the salt within the zeolite, leaving a non-occluded portion of the salt, and permitting the cesium, strontium and barium in the non-occluded portion of the salt to be ion-exchanged with the potassium, sodium or lithium in the zeolite or with cations in the occluded salt, cooling the zeolite containing the cesium, strontium and barium and the salt to form a salt-occluded zeolite, the improvement comprising, forming a mixture of an effective amount of alumina oxide, silicon dioxide and sodium hydroxide with respect to the formation of a sodalite, heating the mixture to about 300° C. to 500° C. partially react the mixture to form water and a sodalite intermediate, maintaining the temperature for a period of time sufficient to drive off the water and form a water-free sodalite intermediate, mixing the water-free sodalite intermediate with the salt-occluded zeolite containing the radionuclides, and hazardous material to form a waste mixture, the mixture containing from about 5 to 13 weight percent of salt, radionuclides and hazardous material, compacting the waste mixture to form a green pellet and heating the green pellet to about 700° C. to about 1000° C. for a period of time sufficient to form sodalite, thereby immobilizing the waste chloride salts containing radionuclides and hazardous material.

9. A method for immobilizing waste chloride salts containing radionuclides and hazardous waste materials for permanent disposal comprising:

mixing 2 moles of NaOH, 1 mole of $Al_2O_3$, and 2 moles of $SiO_2$, to form a mixture, heating the mixture to a temperature of about 300° to 500° C., to react the mixture to form a sodalite intermediate and water, maintaining the temperature for a period of sufficient to drive off the water, forming a water-free intermediate, said intermediate, consisting essentially of a mixture of $NaAlO_2$, $Na_2SiO_3$, $SiO_2$ and $Al_2O_3$, cooling the intermediate in a dry atmosphere and grinding the intermediate to a powder having a particle size of between 50 and 500 μm, mixing the powdered intermediate with a mixed chloride waste salt containing cesium and strontium to form a waste mixture, the waste mixture containing about 10 wt % waste salt, pressing the intermediate-waste mixture at about 350° C. at about 70 MPa for about 1 to 8 hours to form a green compact, and maintaining the pressure and raising the temperature to between 700° and 900° C. for 20 to 200 hours to form sodalite thereby mobilizing the waste salt in the sodalite.

* * * * *